United States Patent [19]

Angelo, II

[11] Patent Number: 4,734,166

[45] Date of Patent: Mar. 29, 1988

[54] FURNACE FOR THE SELECTIVE INCINERATION OR CARBONIZATION OF WASTE MATERIALS

[76] Inventor: James F. Angelo, II, P.O. Box 55275, Little Rock, Ark. 72225

[21] Appl. No.: 10,996

[22] Filed: Feb. 5, 1987

[51] Int. Cl.[4] ..... C10B 1/10; F27B 7/36

[52] U.S. Cl. ..... 202/100; 110/214; 110/246; 202/216; 432/105; 432/109

[58] Field of Search ..... 202/100, 216, 265; 201/27, 32, 33; 48/111; 110/210, 211, 214, 246; 432/109, 110, 117, 105; 34/137, 141

[56] References Cited

U.S. PATENT DOCUMENTS

| | | | |
|---|---|---|---|
| 3,759,795 | 9/1973 | Oliver et al. | 201/27 |
| 3,901,766 | 8/1975 | Smith | 201/32 |
| 4,037,543 | 7/1977 | Angelo | 110/246 |
| 4,038,153 | 7/1977 | Deruelle et al. | 201/27 |
| 4,092,098 | 5/1978 | Honaker et al. | 202/100 |
| 4,273,619 | 6/1981 | Angelo | 202/216 |

*Primary Examiner*—Barry S. Richman
*Assistant Examiner*—Joye L. Woodard
*Attorney, Agent, or Firm*—John A. Hamilton

[57] ABSTRACT

A furnace for the selective incineration or carbonization, by a process of distillation to remove its volatile components, of waste materials, the furnace consisting of an elongated, slightly inclined, rotatable cylindrical kiln, waste material being introduced into its upper end, moved along the length thereof in the form of a tumbling bed at its lower portion by rotation thereof either at higher rates to produce higher turbulence of the material as is useful in the incineration mode of operation, or at lower rates for less turbulence of the material as is useful in the carbonization mode. Air is introduced into the kiln either in large amounts supplying ample oxygen for full combustion as is useful in the incineration mode, or in sub-stoichiometric amounts as is necessary in the carbonization mode. The air is introduced into longitudinally successive zones of the kiln in independently regulated amounts to coincide with the amounts of combustible gas produced in each zone in the carbonization mode, and is circulated in a longitudinal vortex pattern, either in alternately opposite directions in successive zones to supply air-gas turbulence useful in the incineration mode, or in the same direction in all zones as required in the carbonization mode. An afterburner receiving effluent from the kiln is supplied with large amounts of turbulent air for burning the combustible components of the effluent, but has a zone of greatly reduced turbulence allowing solid particulate matter to drop from the effluent by gravity.

6 Claims, 7 Drawing Figures

R1
R2
R3
R4
R4'

FURNACE FOR THE SELECTIVE INCINERATION OR CARBONIZATION OF WASTE MATERIALS

This invention relates to new and useful improvements in furnaces or combustion equipment for treating certain waste materials, and has as its principal object the provision of a furnace which is selectively operable either to thermally destruct and burn all combustible components of the waste material to ash, as completely as reasonably possible, this process being hereinafter for convenience referred to as incineration, or to subject the material to a controlled devolatilization to remove its volatile components to produce charcoals, cokes or other carbons, in a process which will hereinafter for convenience be denoted as carbonization.

BACKGROUND OF THE INVENTION

The characteristics of furnaces required in the case of incineration are quite different from those required for carbonization. For incineration, the materials should be comparatively violently agitated, in a generous supply of air, and subjected to comparatively high turbulence of air flow, during the entire period of combustion, in order to bring about the most complete reduction of the materials to ash as is reasonably possible. On the other hand, for carbonization, the materials may be tumbled for thorough exposure to the air, but should not be agitated in any extreme manner, since such agitation would result in the lowering of product yield. Also, the air supplied for carbonization of the material must be small enough to contain an insufficient quantity of oxygen for causing full combustion of the feed material, so that only partial thermal distillation of the material, producing various carbons, can occur. The flow paths of the material and the air must be carefully controlled and regulated so that only this sub-stoichiometric proportion of oxygen can reach the material being carbonized.

Also, in even the most efficient incinerating furnace, some unburned but combustible gases, as well as incombustible solid particulate matter, will exit from the principal combustion chamber of the furnace. Likewise, the same is true in carbonization furnaces, with the additional fact that carbonization furnaces will inherently produce large quantities of black, noxious smoke, which is highly objectionable as an atmospheric pollutant. In general, a carbonization furnace will produce a relatively large quantity of combustible gases, and a relatively small amount of particulate solids, in its effluent, as compared to an incineration furnace. As a result, it is common in either type of furnace to provide an afterburner of one type or another, having the object of both producing further combustion of any combustible components of the particulate matter, disposing of any remaining incombustible components of the particulate matter, as well as ash, in such a manner that it can be collected and disposed of within the system, and of burning any combustible effluent gases substantially completely, all to the end that the eventual effluent entering the atmosphere is "clean", and permissable under strict environmental protection regulations. However, the requirements for efficient afterburner operation for incineration furnaces also differ from those for carbonization furnaces. A carbonization afterburner, receiving principally only unburned gases, requires principally only an additional quantity of air and oxygen to support combustion of the gases, and some means for retaining the gases for a sufficient time period to complete the combustion thereof. An incineration afterburner, on the other hand, requires not only additional air and retention time, but also extreme turbulence in view of the solid particulate material entering it. Since such turbulence would carry some of the ash and other solid matter through the afterburner and discharge it to the atmosphere, the incineration afterburner should include a zone of quiet, non-turbulent air from which said solid matter may drop into a collection receptacle.

SUMMARY OF THE INVENTION

The principal object of the present invention is the provision of a furnace, including an afterburner, which may readily be adjusted to provide optimum conditions for either incineration or carbonization, as may be desired.

Another object is the provision of a furnace of the character described in which the incineration or carbonization occurs in a single elongated kiln or retort, which is rotatable and is inclined so that waste material fed into the upper end thereof is transported to its lower end by gravity, the finished product, which may be either ash in the case of incineration or carbons in the case of carbonization, being removed from the lower end. The rotary speed of the kiln, and the rate of delivery of air to the kiln, may be set either relatively high to provide the turbulent agitation of the feed material, and the high quantity of air, required for incineration, or relatively low for the relatively non-turbulent flow of the material, and the sub-stoichiometric quantity of air and oxygen, required for carbonization.

Another object is the provision of a furnace of the character described in which air is delivered to the kiln, when operating in its carbonization mode, in such a manner that the oxygen content thereof is consumed in the combustion of combustible hydrocarbon gases driven off from feed material, before it can contact the feed material to cause excessive combustion thereof to ash.

Another object is the provision of a furnace of the character described wherein the only external fuel required is for example natural gas, introduced into the upper end of the kiln and burned only long enough to bring the entering feed material either to full combustion temperature, in the case of incineration, or to a carbonization temperature, which is considerably lower, in the case of carbonization. Thereafter, the external fuel may be shut off, and further incineration or carbonization will occur spontaneously. In the case of carbonization, combustion of the hydrocarbon gases emitted from the carbonizing material, away from said material, will dry newly entering material and bring it to carbonization temperature.

Another object is the provision of a furnace of the character described in which the feed material moves through the kiln in the form of a tumbling bed in the lower portion thereof, and wherein air is introduced tangentially into the upper portion of the kiln to move around the periphery of the kiln in a vortex flow, whereby combustible gases rising from the bed, in the carbonization mode, intermix with the air and burn with the oxygen content thereof before said oxygen reaches the bed to cause undesirably complete combustion thereof.

Another object is the provision of a furnace of the character described wherein air is delivered to successive longitudinal portions of the kiln by independently regulated means. This permits the quantity of air delivered to each section to be regulated according to the furnace zone in which the production of the combustible gases occur. Excess air delivered to zones in which little gas is produced could result in oxygen reaching the material bed, and insufficient air delivered to zones in which large amounts of gas are produced could result in combustion of only insufficient gas to produce the heat necessary to maintain the system in operation by heating the newly introduced material to carbonization temperature.

Another object is the provision of a furnace of the character described in which air may be introduced into the kiln either in the same tangential direction in all of the longitudinal zones thereof, in order to produce as little turbulence as possible in the carbonization mode, or in alternately opposite tangential directions, in order to produce the added turbulence beneficial in the incineration mode.

Another object is the provision of a furnace of the character described including an afterburner through which the kiln effluent passes, and including means for introducing additional air and producing extreme turbulence of air and gas flow therein, in order to produce combustion of any combustible elements of the effluent to as complete a degree as possible.

Another object is the provision of a furnace of the character described in which the afterburner constitutes an elongated passage through which the kiln effluent passes, and provided intermediate its ends with a zone within which very little turbulence occurs. This gives opportunity for any ash or other incombustible solid particulate matter to drop from the flow into a receptacle from which it may be periodically removed, rather than passing through to be ejected into the atmosphere. In all other portions of the afterburner, the alternately reversing helical flow patterns maximize both the time of retention of the material flowing therein, and also maximize the turbulence to which said material is subjected, whereby to promote better and more efficient combustion thereof.

With these objects in view, as well as other objects which will appear in the course of the specification, reference will be had to the accompanying drawing, wherein:

DESCRIPTION OF THE PREFERRED EMBODIMENT

Figures 1, 2, 3, 4, 5, 6, 7:
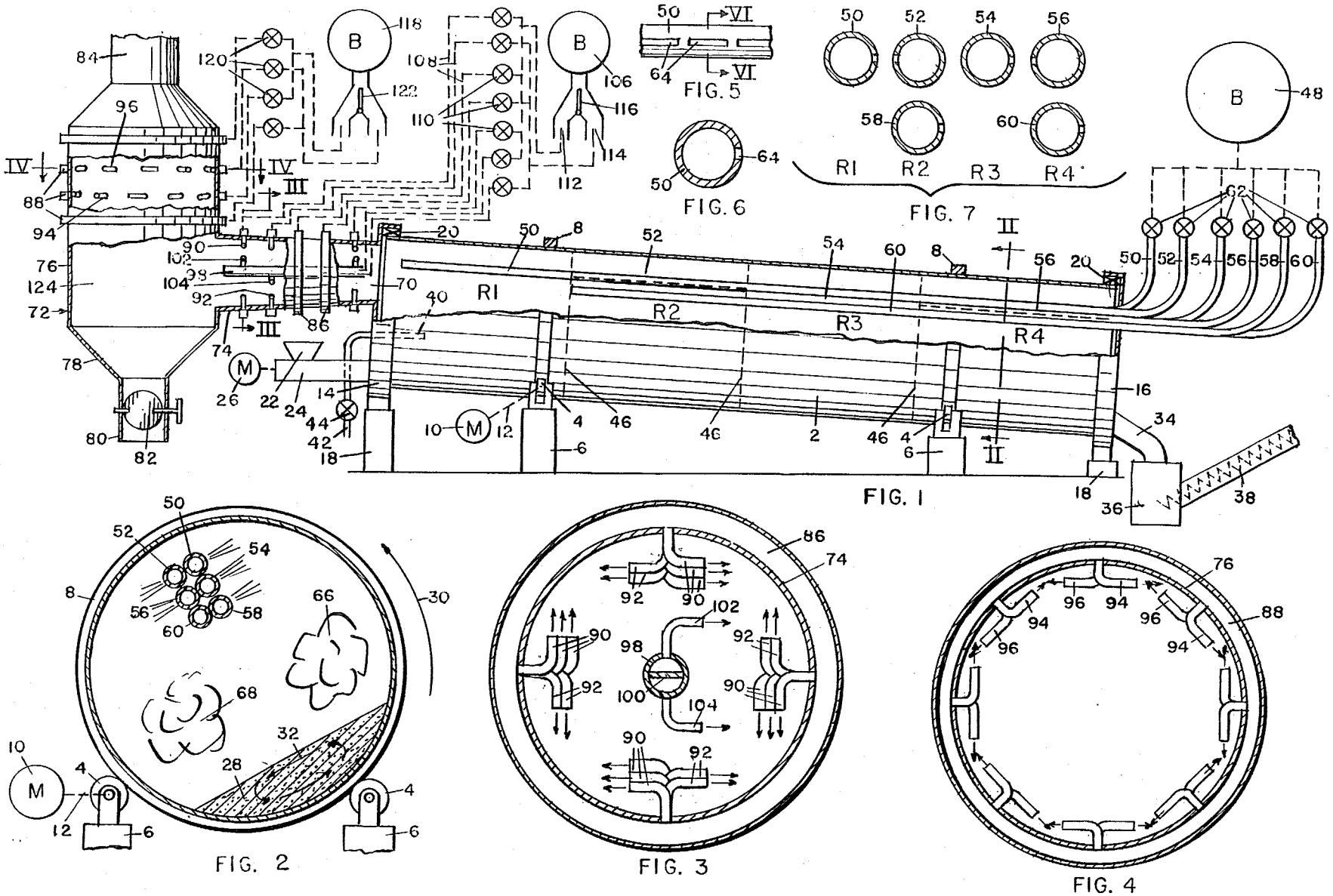
FIG. 1 is a partially schematic side elevational view, shown partially in section, of a furnace for the selective incineration or carbonization of waste materials embodying the present invention.
FIG. 2 is an enlarged sectional view taken on line II—II of FIG. 1.
FIG. 3 is an enlarged sectional view taken on line III—III of FIG. 1.
FIG. 4 is an enlarged sectional view taken on line IV—IV of FIG. 1.
FIG. 5 is a fragmentary side elevational view of one of the pipes injecting air into the kiln.
FIG. 6 is an enlarged sectional view taken on line VI—VI of FIG. 5.
FIG. 7 is a diagrammatic representation of the six pipes injecting air into the kiln, indicating the direction of air injection of each.

Like numerals apply to similar parts throughout the several views, and the numeral 2 applies to an elongated cylindrical kiln disposed in such a position that its axis is inclined slightly from the horizontal. It is supported for rotation about its axis by pairs of rollers 4 distributed along its length, said rollers being carried by ground-engaging bases 6 and engaging metal tracks 8 surrounding the kiln. At least one of said rollers is rotatably driven by a variable speed motor 10, through a driving connection 12 therebetween, whereby the kiln may be turned at any desired rate. Said kiln is closed at its upper end by a fixed end wall 14, and at its lower end by an end wall 16, said end walls being supported by ground-engaging bases 18, and leakage of air between the end walls and the interior of the kiln is prevented by seals 20. Feed material, such as hazardous or toxic wastes, solid municipal waste, or other carbonaceous material, may be fed into a hopper 22, and from thence forced by a ram feeder 24 driven by a variable speed motor 26 through upper end wall 14 into the upper end of kiln 2. Rotation of the kiln by motor 10, and its inclination from horizontal, then causes the feed material to proceed gradually downwardly along the lower portion of the kiln in the form of a tumbling bed 28, as indicated in FIG. 2. The material bed will tend to climb up the ascending side of the kiln, which is turned in the direction of arrow 30 in FIG. 2, until it reaches its normal angle of repose, and will then tumble in the direction of arrowed loop 32 in FIG. 2. After it has passed through the full length of the kiln and been acted on by the thermal process occuring therein, as will be described, any remaining solid material, whether it be charcoal if the furnace is operating in carbonization mode, or ash if the furnace is operating in incineration mode, or incombustible material in either case, will pass through lower end wall 16 into a conduit 34, thence through a quencher 36, and finally transported by an auger conveyor 38 to a subsequent station for disposal or further processing, as may be the case. An external fuel, such as natural gas, is introduced into the upper end of the kiln by a nozzle 40 through upper end wall 14, and supplied by a gas pipe 42 regulated by a valve 44.

Referring to FIG. 1, it will be seen that kiln 2 may be considered to be divided by imaginary lines 46 into a series (four shown) of longitudinally successive zones, designated R1, R2, R3 and R4, starting from the upper end of the kiln. Air is supplied by a power driven blower 48 into each of a set of six pipes 50, 52, 54, 56, 58 and 60. Each of these pipes is controlled by a separate valve 62, by means of which air flow therethrough may be turned on or off, or regulated as to flow rate. Each pipe supplies air to only one of the kiln zones R1–R4, being longitudinally slotted, as indicated at 64 as indicated in FIGS. 5 and 6, only within the longitudinal span of the zone to which it is to supply air. The pipes project through lower end wall 16, and are gathered in a cluster in the upper portion of the kiln, being supported by any suitable means, not shown. It will be understood from FIG. 7 that pipes 50, 54, 58 and 60, supplying zones R1, R2, R3 and R4 respectively are all arranged to direct air in a tangential direction operable to produce a clockwise flow within the kiln, as viewed in FIG. 2, while pipes 52 and 56, supplying zones R2 and R4 respectively, are arranged to direct air in a tangential direction operable to produce a counter-clockwise flow of air within the kiln.

Thus in the incineration mode of operation, the feed material to be incinerated is fed into the upper end of the retort by feeder 24 and is initially ignited by the combustion of exterior fuel from nozzle 40. For incineration, valves 62 are adjusted to supply air only to pipes 50, 52, 54 and 56, and to supply a maximum quantity of air to all of them, since in incineration there is no need to limit the air to substoichiometric proportions to prevent undesirable full combustion of the feed material. Also, variable speed motor 10 is preferably set to provide a relatively high rotational speed to the kiln. The alternately opposite clockwise and counter-clockwise directions of air flow in the successive kiln zones produces a high degree of air and gas turbulence within the kiln, particularly in the areas adjacent lines 46 where the air-gas rotation of one zone meet the counter-rotating air-gas mixture of the next successive zone. This turbulence, together with the large quantity of air supplied by blower 48 and the turbulence in the material being processed introduced by the relatively high speed of rotation of the kiln, produces highly efficient combustion of the material within the kiln. However, the turbulence also results in the fact that the effluent from the kiln will contain certain amounts of particulate matter, some of which may be combustible, and inevitably some gases which may still be combustible, even though the latter may be of small amount, since most of the gas will have been consumed in the kiln by the large air supply therein.

In the carbonization mode of operation, on the other hand, the feed material to be carbonized is introduced into the kiln and brought to carbonization temperature by the external fuel as before, and the external fuel may then be shut off, since the reaction is spontaneous and self-sustaining once initiated, and the feed material is continuously dried and brought to carbonization temperature by partial combustion of the gases emitted by the material during the carbonization reaction. The valves 62 are set to terminate any air supply to pipes 52 and 56, and to initiate air supply to pipes 58 and 60, so that the air current is in the same direction, that is clockwise, in all zones of the furnace, thereby reducing air-gas turbulence within the kiln. Valves 62 are also then restricted to deliver only sub-stoichiometric proportions of air to each zone, and variable speed motor 10 is adjusted to turn the kiln at a comparatively slow speed, so that turbulence of the material bed 28 itself is also reduced. The reduction of turbulence greatly reduces bodily intermixture of the gases with the feed material within the kiln, so as to reduce any possibility of contact of the free oxygen of the entering air with the material, which could produce unacceptable full combustion of the material, and also reduces entrainment of solid particles of the material in the gases. However, the gases within the kiln still circulate continuously in a clockwise direction, and the material within bed 28 still tumble as before, but with reduced turbulence.

It is of course very important in carbonization that the free oxygen of the air not reach or engage the tumbling bed of material, to prevent full oxidation of any part thereof. A consideration of FIG. 2 will show that the hot, combustible hydrocarbon gases emitted by the carbonizing bed 28 are caused to flow in a clockwise direction around the interior of the kiln, due to the vortex flow created by the tangential injection of air jets by the then operating air pipes 50, 54, 58 and 60. As the gas reaches the top of the furnace, it intermingles with the air injected by the jets, and continues around the kiln. It is amply hot at this time to burn if supplied with oxygen, and the air supplies oxygen, so that then the gas is burned to the extent allowed by the amount of air admitted, the combustion occurring principally in a "fireball" 66, readily observable, which occurs at the side of the kiln on which the air-gas flow is downward. Thus the gas flowing over the surface of material bed 28 is substantially inert and free of oxygen, so that virtually no further oxidation of the bed material can occur. The combustion of the gas, to the extent permitted by the oxygen admitted, supplies the heat necessary to render the carbonization reaction continuous, by drying the continuously admitted fresh material and heating it to carbonization temperature. For this condition to prevail, the air-gas flow around the interior of the kiln must be substantially smooth and non-turbulent, and this smooth, non-turbulent flow is brought about by rendering the air-gas flow the same, that is clockwise, in all zones of the kiln. The second fireball 68 shown in FIG. 2, at the side of the kiln opposite from fireball 66, occurs only in kiln zones R2 and R4, when the direction of flow in those zones is reversed from that in zones R1 and R3. This condition exists in the incineration mode, and tends to increase combustion efficiency in that mode of operation, when full combustion of the entire mass of feed material is desired, but is not used in the carbonization mode of operation.

The independent injection and control of air into each of the kiln zones R1 and R4, under the control of valves 62, has the function not only of permitting full control of the total amount of air admitted to the kiln, but also of permitting different and closely regulated amounts of air to be delivered to each successive zone. This is important in the carbonization mode of operation, since due to the nature and makeup the feed material being used, and to the degree of moisture carried in the feed material, which will necessitate that it travel greater or lesser distances through the kiln before it can be thoroughly dried and brought to carbonization temperature, the combustible gases emitted by the material during carbonization may be produced principally in one zone or another of the kiln. Excessive air delivered to kiln zones in which little gas is produced can result in free oxygen reaching the bed 28 and causing undesired oxidation thereof, while deficient air delivered to zones in which much gas is produced can result in insufficient combustion of the gas to produce the quantity of heat necessary to preserve the continuity of the carbonization reaction. By proper adjustment of valves 62, an optimum amount of air may be delivered to each zone of the kiln regardless of the quantity of gas produced in that particular zone.

The effluent of the kiln, which as discussed above will contain certain amounts of entrained particulate matter and relatively small amounts of combustible but unburned gases in the incineration mode of operation, and of relatively large amounts of combustible but unburned gases and relatively small amounts of entrained particulate matter in the carbonization mode of operation, leaves the kiln through an aperture 70 formed in upper fixed end wall 14, and passes through a compound after burner indicated generally by the numeral 72, and including a relatively small diameter horizontal conduit 74 interconnected at its outer end into the lower portion of a relatively large diameter vertical conduit 76. The lower end of vertical conduit 76 forms a conical hopper 78 into which solid particulate matter is induced to fall by gravity, and from which said particulate matter may be removed periodically through an outlet neck 80 controlled by a manually operable valve 82. The upper end of vertical conduit 76 is connected directly to a stack 84, which generates the draft necessary to draw the effluent from the kiln and to discharge the afterburner output upwardly into the atmosphere, either through a stack, or through a heat recovery device interposed between the afterburner and the stack. For "clean" operation, and to render the system acceptable under strict environmental protection regulations, it is necessary that the gases be substantially fully burned, and that the particulate matter be substantially fully removed, since both are highly polluting to the atmosphere. This is the function of the afterburner.

The horizontal conduit 74 of the afterburner is surrounded by a series of air plenum rings 86, and the vertical conduit of the afterburner is surrounded, above the level of the horizontal conduit, by a series of air plenum rings 88. Said plenum rings are spaced apart longitudinally along their associated conduits. Each plenum ring is provided with nozzles interconnected thereinto and operable to direct jets of air tangentially into the associated conduit. As shown in FIGS. 1 and 3, the nozzles 90 of alternate plenum rings 86 of horizontal afterburner conduit 74 are positioned to direct air jets in a clockwise direction in conduit 74, as viewed in FIG. 3, while nozzles 92 of the intervening plenum rings are positioned to direct air jets into conduit 74 in a counter-clockwise direction. Likewise, the nozzles 94 and 96 of successive plenum rings 88 of vertical afterburner conduit 76 are arranged to direct air jets tangentially into conduit 76 in alternately clockwise and counter-clockwise directions. Additionally, horizontal afterburner conduit 74 is provided with a smaller air pipe 98 supported coaxially therein by any suitable means, not shown, and divided longitudinally into two separate channels by a partition wall 100 (see FIG. 3). One of these channels is provided, in alignment with each of the plenum rings 86 having nozzles 90 producing clockwise jets, with a nozzle 102 producing a jet in the same clockwise direction, and the other channel is provided in alignment with each of the plenum rings 86 producing counter-clockwise jets, with a nozzle 104 producing a jet in the same counter-clockwise direction.

Air is supplied to all of the plenum rings 86 of horizontal afterburner conduit 74, and to central air pipe 98 thereof, by a power driven blower 106. Separate air conduits, indicated diagrammatically by dashed lines 108, are provided for delivering air from said blower to each of plenum rings 86, and to each channel of central air pipe 98, each of said conduits being independently controlled by a manually operable valve 110. Between said valves and blower 106, the conduits are so combined and grouped that one outlet 112 of the blower delivers air only to those plenum rings 86, and to the channel of central air pipe 98, operable to deliver clockwise jets into afterburner conduit 74, while the other blower outlet 114 delivers air only to those plenum rings 86, and to the channel of central air pipe 98, operable to deliver counter-clockwise jets into conduit 74. A manually operable divider valve 116 may be adjusted to deliver more air to one of its outlets than to the other, whereby to reinforce either clockwise or counter-clockwise rotation of the air in conduit 74. Similarly, a power driven blower 118 is operable to deliver air to each of the air chests 88 of vertical afterburner conduit 76, each under the separate control of a regulating valve 120, and controlled by a divider valve 122 to divide the air as desired between those plenum rings operable to produce clockwise jets, and those operable to produce counter-clockwise jets.

As the kiln effluent is drawn into horizontal afterburner conduit 74 and drawn therethrough by the stack draft, it is subjected to extreme turbulence due to the alternately opposite jet vortex action to which it is subjected, this turbulence being further enhanced by the relatively restricted confines of conduit 74. The turbulence provides extremely thorough contact between the air delivered by blower 106 and the combustible components of the effluent, whereby to promote efficient combustion thereof, and also retains the effluent within conduit 74 for a maximized period of time, in order for the combustion to proceed as completely as possible. The function of central air pipe 98 is not only to provide additional turbulence by the jets carried thereby, but also to bodily fill the central core zone of conduit 74. Otherwise, the jets would tend to create a relatively quiescent core zone through which some of the effluent could pass with relatively little turbulence, and hence with only partial combustion. The function of divider valve 116 is to combat the tendency of the effluent emerging from the kiln into the afterburner to rotate naturally in one direction or the other with sometimes considerable force. By adjusting valve 116 to deliver air more strongly to those jets combating the natural rotation of the effluent, and less to those favoring it, a condition of maximum turbulence is produced. This "natual" tendency of the effluent in conduit 74 may be the result of air-gas flow patterns existing in kiln 2 itself, or of other causes. The purpose of valves 110 is not basically to limit the supply of air to conduit 74, since the most efficient combustion therein is favored and promoted by supplying an even excessive amount of air thereto. Instead, said valves have a function to be described presently.

As the effluent, with the combustible gases and any combustible components of the particulate matter now largely consumed, exits from the outer end of horizontal conduit 74, it enters the large lower end portion of vertical afterburner conduit 76, which constitutes a "dropout" zone 124 in which the air is relatively quiescent, giving any unburned particulate matter still entrained therein good opportunity to drop into hopper 78 by gravity, rather than being maintained in entrainment in the air by turbulence thereof and carried on out of the stack. The quiescence is obtained both by the fact that the sudden increase of volume in the drop-out zone creates a sudden decrease in turbulence, and by the fact that in any event the effluent must at this point change direction from horizontal to vertically upwardly. This also produces at least a momentary drop in turbulence. The quiescence of zone 124 may be still further enhanced and increased by adjusting valves 110, to produce a gradual drop in turbulence in horizontal afterburner conduit 74 throughout its length, by delivering less air to the air chests 86 closer to the drop-out zone. Finally, the remaining gases are drawn upwardly by the draft through the upper portion of afterburner conduit 76, where it is subjected to a final period of extreme turbulence by the air jets delivered by air chests 88, in order to perform final combustion of any combustible components still present in the effluent before it is discharged through stack 84, or to an energy recovery device, such as a boiler, interposed between the afterburner and the stack. Here again, divider valve 122 may be adjusted to equalize the clockwise and counterclockwise jets to provide maximum turbulence, and valves 120 may be adjusted, for example, to reduce turbulence just above the drop-out zone to further avoid driving particulate matter up the stack. Inclusion of the dropout zone is of course particularly useful in the incineration mode of operation, since the kiln effluent in that case will ordinarily contain some amounts of particulate matter, but even the carbonization mode of operation will still produce small amounts of particulate matter in the kiln effluent. In the carbonization mode of operation, however, relatively smaller amounts of particulate matter are contained in the kiln effluent, and valves 110 and 120 may be set to maintain maximum turbulence throughout both sections of the afterburner, in order to provide for maximum efficiency of combustion of the combustible gases in the effluent, which are ordinarily produced in large quantities in the carbonization mode.

Thus it will be apparent that a furnace which is capable of selectively performing either of two quite different pyrolytic functions on virtually any carbonaceous material has been provided. It will perform either the substantially complete gasification and thermal destruction of the material in what has been denoted the incineration mode, or the partial thermal destruction of the material by destructive distillation or controlled devolatilization of its volatile components, in what has been denoted the carbonization mode. In either case the process is continuous and automatic as the material is moved without interruption through a single kiln or retort, and the transfer from one mode of operation to the other may be made very simply, without tools and without requiring revision or change of the basic apparatus. In either case, the final flue discharged of the furnace to the atmosphere may be rendered substantially clean and non-polluting to the atmosphere.

While I have shown and described a specific embodiment of my invention, it will be readily apparent that many minor changes of structure and operation could be made without departing from the spirit of the invention.

What I claim as new and desire to protect by Letters Patent is:

1. A combustion device for selectively incinerating, or carbonizing a carbonaceous feed material by a process of controlled devolatilization, comprising:

a. an elongated cylindrical kiln inclined slightly from the horizontal and having an upper end and a lower end, b. means operable to introduce a solid carbonaceous feed material into the upper end of said kiln, means for rotating said kiln to move the feed longitudinally through said kiln in the form of a tumbling bed in a lower portion thereof, and means to discharge remaining solid material from the lower end thereof, c. means operable to elevate the temperature of said feed material in the kiln to either incineration or carbonizing temperature, only until the desired temperature is obtained, d. means located in an upper portion of the kiln to introduce air into the full length of said kiln into the upper portion thereof only, so as to flow in a generally helical vortex flow around the interior periphery thereof in the same peripheral direction throughout the full length of the kiln, or alternatively in alternately opposite peripheral directions in longitudinally successive zones of the kiln, e. draft inducing means operable to create a draft in said kiln toward an outlet end thereof, and f. afterburner means interconnected to the draft outlet of said kiln, and operable to produce combustion of combustible gaseous or solid components entrained in said draft.

2. A device as recited in claim 1 wherein said air introduction means comprises a series of air pipes extending longitudinally in the upper portion of said kiln, and each operable to deliver air through jets to a single one of longitudinally successive zones of said kiln, alternate ones of said zones being supplied by two of said air pipes operable to deliver air to those zones in respectively opposite peripheral directions, and control means whereby in those kiln zones supplied by two air pipes, one or the other of said two pipes may be rendered operable to deliver air, and the other inoperable.

3. A device as recited in claim 2 with the addition of adjusting means whereby the quantity of air delivered by each of said air pipes may be independently adjusted, whereby to adjust both the total quantity of air delivered to the kiln, greater quantities being required for incineration than for carbonization, and also to adjust the quantity of air delivered to each successive longitudinal zone of the kiln, whereby to concentrate the air delivery to those zones producing the greatest amount of combustible gas, during the carbonization mode of operation, or to slag or "glassify" the ash in the final zone before discharge in the incineration mode.

4. A device as recited in claim 3 wherein said means for rotating the kiln is rotatable at variable rates of rotation, higher rates being conducive to greater turbulence of the material within the kiln, as required for efficient incineration, and lower rates being conducive to less turbulence of the material as required for efficient carbonization.

5. A device as recited in claim 1 wherein said afterburner means comprises:

a. A tubular conduit interconnecting said kiln and said draft producing means, and through which the effluent of said kiln, containing greater or lesser amounts of combustible gas and particulate matter, passes to reach said draft producing means, which discharges effluent to the atmosphere, and b. means operable to deliver air to said tubular conduit in the form of jets operable to create a high degree of turbulence therein, said air jets being directed into said tubular conduit to produce peripheral vortex flow of said air around the interior of said conduit, said jets being positioned to direct air in alternately opposite peripheral directions at successive longitudinal portions of said conduit, whereby to produce a maximum of turbulence.

6. A furnace as recited in claim 5 with the addition of means operable to adjust the relative amounts of air delivered to those jets operable to produce peripheral flow in one direction as compared to those jets operable to produce peripheral flow in the opposite direction, whereby the peripheral flow in opposite directions may be balanced despite any tendency of the effluent flow therein to turn in one direction or the other, in order to produce a maximum turbulence, and also to maximize the time of retention of the gases in the afterburner.

* * * * *